US006637062B2

(12) United States Patent
Braun et al.

(10) Patent No.: US 6,637,062 B2
(45) Date of Patent: Oct. 28, 2003

(54) METHOD FOR OPERATING A FRONT-LOADING WASHING MACHINE

(75) Inventors: Walter Braun, Schorndorf (DE); Michael Laue, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 164 days.

(21) Appl. No.: 09/992,910

(22) Filed: Nov. 14, 2001

(65) Prior Publication Data

US 2002/0073492 A1 Jun. 20, 2002

(30) Foreign Application Priority Data

Nov. 15, 2000 (DE) ..... 100 56 570

(51) Int. Cl.[7] ..... D06F 33/02
(52) U.S. Cl. ..... 8/159; 69/12.04; 69/12.05
(58) Field of Search ..... 68/12.02, 12.04, 68/12.05, 12.06, 12.19, 23.7, 25, 140, 58; 8/159, 158

(56) References Cited

U.S. PATENT DOCUMENTS 5,419,163 A * 5/1995 Kim et al.
5,669,095 A * 9/1997 Dausch et al.
5,720,064 A * 2/1998 Koo
5,878,456 A * 3/1999 Lee
5,897,672 A * 4/1999 Badami et al.
6,023,950 A * 2/2000 Battisella
6,029,299 A * 2/2000 Baek et al.
6,564,413 B2 * 5/2003 Braun et al.

FOREIGN PATENT DOCUMENTS

JP 53-142053 * 12/1978
JP 1-32095 * 12/1989
JP 3-292998 * 12/1999

OTHER PUBLICATIONS

European Patent Application 294,014 Dec. 1988.*

* cited by examiner

*Primary Examiner*—Frankie L. Stinson
(74) *Attorney, Agent, or Firm*—Thomas J. Roth; Robert O. Rice; John F. Colligan

(57) ABSTRACT

The invention concerns a method for operating a front-loading washing machine with a washing aggregate comprising of a tub holding a rotatably-mounted drum suspended in the machine housing so as to be able to oscillate with a midaxis descending from front to back and equipped with an imbalance sensor that changes the rotation of the drum by means of a control program when an imbalance occurs in the spin cycle. In many cases of operation involving small amounts of sensitive types laundry an improved spin result can be achieved, by attending to the preset optimum filling amounts, taking into account the weight and absorbency, and by disabling the imbalance sensor and running the spin cycle at maximum speed.

9 Claims, 2 Drawing Sheets

METHOD FOR OPERATING A FRONT-LOADING WASHING MACHINE

BACKGROUND OF THE INVENTION

1. Field of the Invention

The invention concerns a method for operating a front-loading washing machine with a washing aggregate consisting of a tub holding a rotatably-mounted drum suspended in the machine housing so as to be able to oscillate with a midaxis descending from front to back and equipped with an imbalance sensor that changes the rotation of the drum by means of a control program when an imbalance occurs in the spin cycle.

2. Description of the Related Art

In a front-loading washing machine of this kind as a result of the physical laws of gravity and centrifugal force an asymmetrical imbalance occurs at a specific point precisely when the laundry loads are small. In an inclined washing aggregate the small amount of laundry always travels to the back and bottom of the drum above all during the spin cycle and collects there at the lowest point. Due to the laws of leverage, the bearing load is less when imbalances occur here at the rear of the drum, i.e., in the immediate vicinity of the drum bearing, than is the case for imbalances occurring at the front loading area of the washing aggregate. In addition to this, during the spin cycle run-up in a washing aggregate that is inclined, a small amount of laundry is better distributed along the rear wall of the drum, i.e., the laundry is more advantageously pulled apart. This also has a positive effect on the imbalance behavior; at the least the degree of imbalance is reduced.

The problem of the invention is to improve spin results by creating a method for operating a front-loading washing machine of the above-mentioned type that in simple way takes optimal maximum advantage of the better imbalance conditions that occur with small loads of sensitive laundry such as wash-and-wears, delicates, wools and hand-washables.

SUMMARY OF THE INVENTION

This problem is solved according to the invention in that when the washing drum is loaded with laundry with a preset optimum filling amount, the weight and the absorbency of the loaded laundry is determined, and in that up to a preset weight of 150% of the optimum filling amount and up to an absorbency of 150% of the optimum filling amount the imbalance sensor and its effects on the control program are disabled and the laundry in the drum is spun at a maximum preset speed.

When the drum is loaded with sensitive laundry, the optimum filling amount must be taken into account, which loads to improved imbalance conditions. It is then possible to achieve operating conditions in which the spin cycle can be run at maximum speed without activating the imbalance sensor. In the process the preset values for the weight of the loaded laundry and its absorbency are the decisive factor and are used to select whether to operate the spin cycle with or without activation of the imbalance sensor, and thus whether the imbalance sensor influences or does not influence the control program. The determined settings load to an optimizing of the spin results without overloading the drum through the occurrenced imbalances. The settings are based on and adapted to both the capacity of the drum (in dry laundry) and tested and recommended optimum filling amounts for the various laundry types.

BRIEF DESCRIPTION OF THE DRAWINGS

The invention will be further explained with reference to a process flow chart.

Shown are.

DESCRIPTION OF THE PREFERRED EMBODIMENT

Thus according to one embodiment for a drum capacity of 9 kg, the optimum filling amount for wash-and-wear laundry is preset at 3 kg, and at 2 kg for delicates, wool and hand-washables. Corresponding proportions are of course also applicable for other drum capacities.

The procedure based on the invention can be designed according to other embodiments such that for a determined weight of loaded laundry up to the optimum filling amount without taking into account the absorbency, the spin cycle is run by the control program at a maximum preset speed, or such that for a determined weight of loaded laundry above the preset weight the spin cycle is run by the control program with the imbalance sensor activated without taking into account the water absorbency, or such that up to the preset weight and with an absorbency greater than 300% of the optimum filling amount the spin cycle is always run by the control program with imbalance sensor activated.

Here a further improvement in the spin result can be achieved in that up to the preset weight and an absorbency between 150% and the optimum filling amount the spin cycle is run at maximum speed only when the determined weight is below 150% of the optimum filling amount and in that for an absorbency between 150 and 300% of the optimum filling amount the spin cycle is run at maximum speed only when the determined weight is <150% of the optimum filling amount, whereas for a weight greater than this preset second weight the spin cycle is run with the imbalance sensor activated.

The laundry type is manually set, in particular, preselected. If provision is made according to further development that the preset weight and absorbency values are stored in a microchip that is supplied with the determined weight and absorbency values, then the control program can be used in a simple way to improve the spin results since it obtains the signals it needs for this purpose from the microchip.

Figure 1:
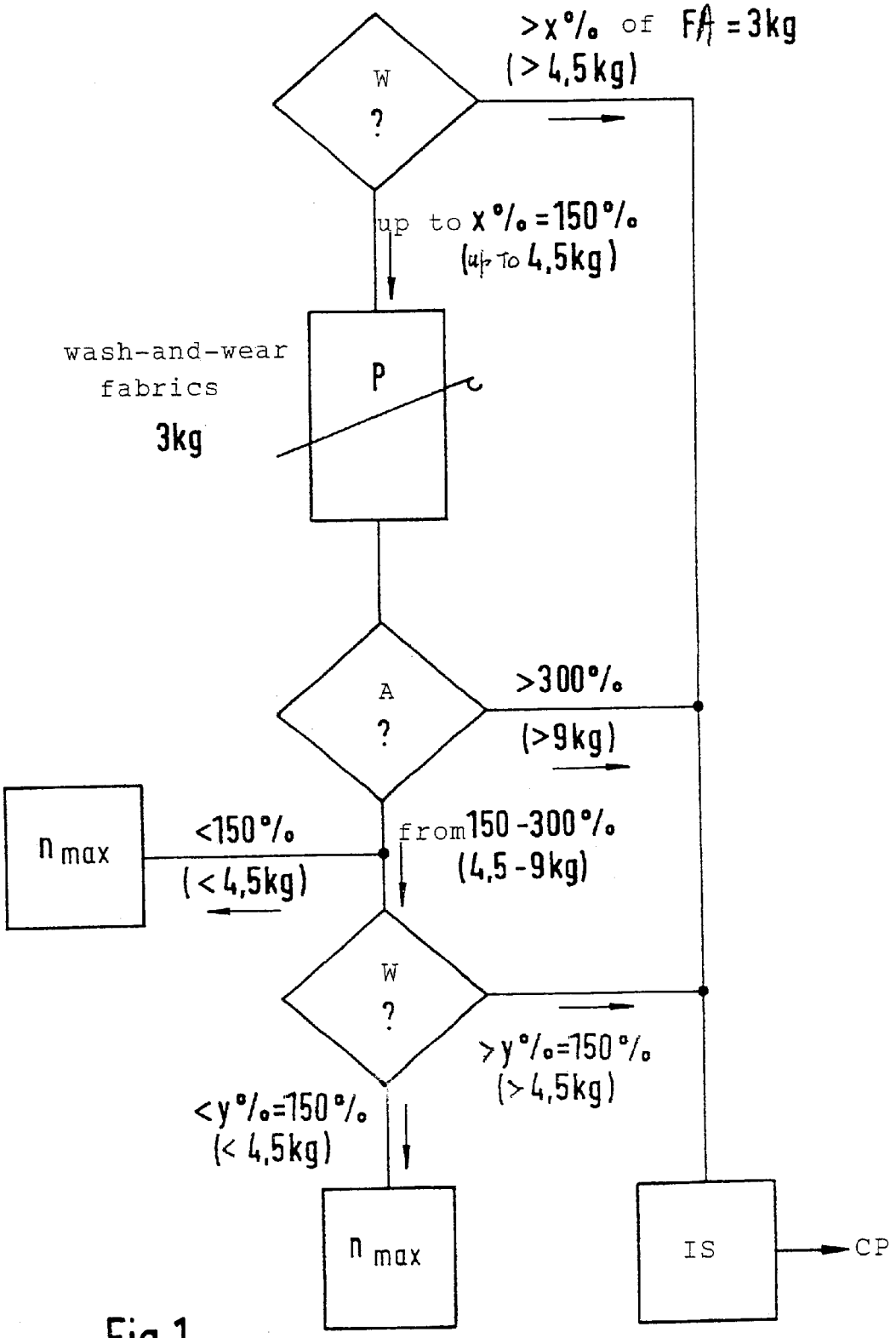
FIG. 1 A flow chart for wash-and-wear laundry.

As shown in the flow chart in FIG. 1, the wash-and-wear laundry loaded in the drum is weighed and the weight W is determined. If the washer has a recommended optimum filling amount FA of 3 kg for wash-and-wear laundry, then a proportion of x%=150%, i.e. 4.5 kg, can be preset and stored as the first preset weight W. If the loaded laundry exceeds this value of 4.5 kg, then the imbalance sensor IS is activated and the spin cycle is run by the control program CP conventional in the manner relative to the arising imbalance.

If the weight W of the loaded laundry is below 4.5 kg, then the absorbency A of the laundry is also measured.

If this is above 300% of the recommended filling amount of 3 kg, then the imbalance sensor IS is continuously activated, and the spin cycle is run relative to imbalance by the control program CP. If the water absorbency A is less than 150% of the optimum load of 3 kg, i.e., <4.5 kg, then the spin cycle can be run without the imbalance sensor IS at a maximum speed, e.g. $n_{max}$=1,400 rpm.

If the absorbency A is between 150% and 300%, i.e. between 4.5 and 9 kg, then the weight W of the loaded laundry is taken into account, whereby a value of 150% is assumed for y as a second preset weight. This means the second preset weight of 4.5 kg for the selected percent y=150%. If the determined weight W is <4.5 kg, then the spin cycle can be run at a maximum speed, e.g. $n_{max}$=1,400 rpm without the imbalance sensor IS even with an absorbency A of 150 to 300%, i.e. 4.5 to 9 kg. Only for a weight W >4.5 kg and the given absorbency A of 150 to 300%, e.g. 4.5 to 9 kg, the spin cycle is run by the control program CP relative to imbalance with the imbalance sensor IS activated.

Figure 2:
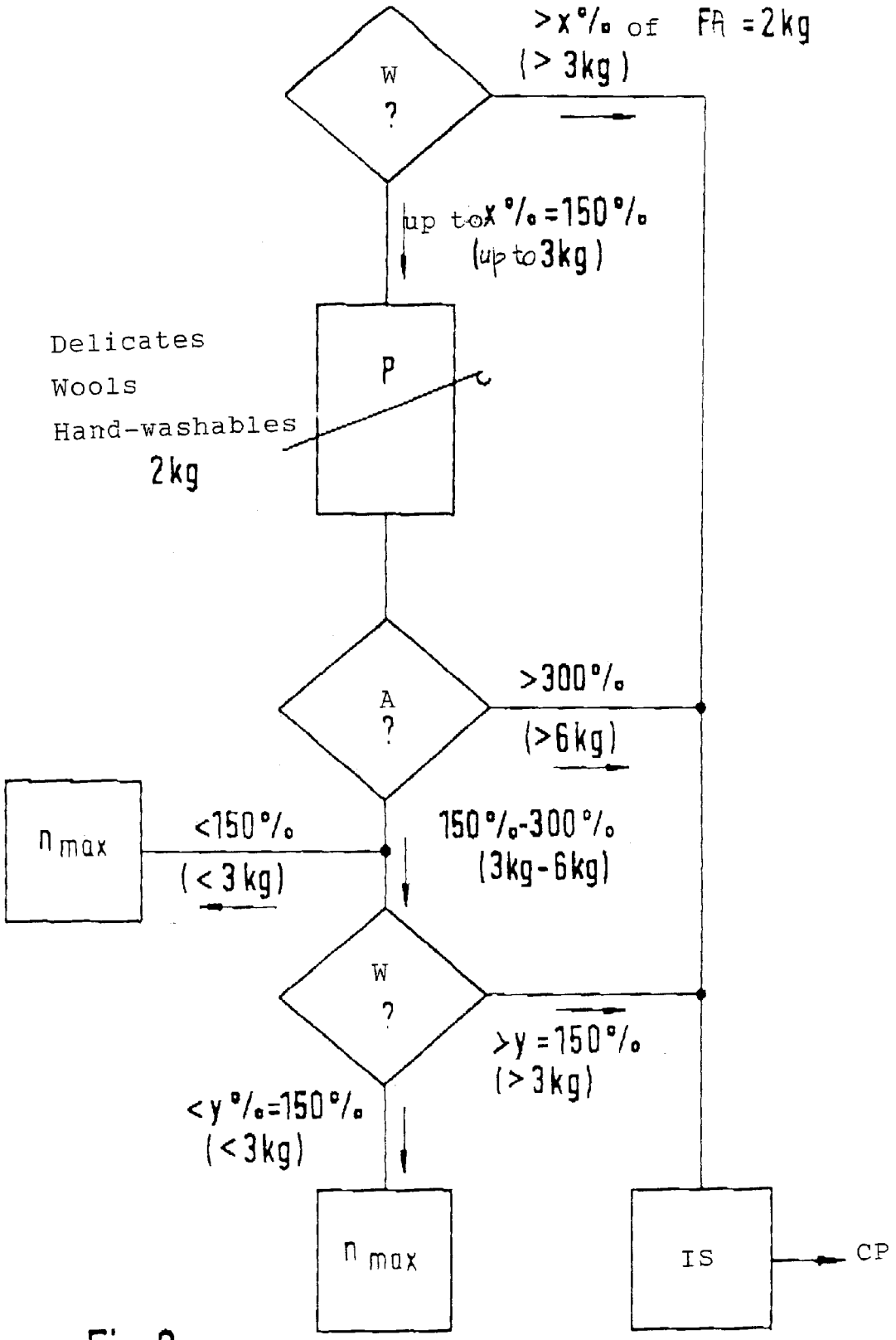
FIG. 2 A flow chart for delicates, wools and hand-washables.

The preset percentage values also apply accordingly for other drum capacities and for other optimum filling amounts for other types of laundry, as shown by the flow chart in FIG. 2 for the laundry types delicates, wool and hand-washables. For a washing machine with a capacity of 9 kg, an optimum filling amount of only 2 kg is recommended for these types of laundry. Consequently, already at a weight of >3 kg the spin cycle is always run by the control program CP with the imbalance sensor IS activated. At a weight W of <3 kg, the absorbency A>300%, i.e. >6 kg, leads to the same spin cycle, whereas for an absorbency A<150%, e.g. <3 kg, the spin cycle is run at maximum speed, e.g. $n_{max}$=1,100 rpm.

If the absorbency A is between 150 and 300% of the optimum filling amount of 2 kg, i.e., between 3 and 6 kg, then the weight W of the loaded laundry is again taken into account. For a selected percentage value y of 150%, the weight W in thus preset at 3 kg in the second step. Thus given an absorbency A of 150–300% and a weight W<3 kg, the drum can be spun at the maximum speed of, for example, $n_{max}$=1,100 rpm, whereas for a determined weight>3 kg the spin cycle is run relative to imbalances with imbalance sensors IS activated.

The maximum speed $n_{max}$ is preset for the washing machine and can of course also be more or less than 1,400 rpm. A maximum speed of $n_{max}$=1,400 rpm is preset for wash-and-wear laundry, whereas a speed of $n_{max}$=1,100 rpm is set for delicates, wool and hand-washables.

We claim:

1. A method for operating a front-loading washing machine with a washing aggregate comprising a tub holding a rotatably-mounted drum suspended in the machine housing so as to be able oscillate with a midaxis descending from front to back and equipped with an imbalance sensor that changes the rotation of the drum by means of a control program when an imbalance occurs in the spin cycle, wherein when the washing drum is loaded with laundry whose optimum filling amount is preset, the weight and the absorbency of the loaded laundry is determined, and are disabled up to a preset weight of 150% of the optimum filling amount and up to an absorbency of 150% of the optimum filling amount, the imbalance sensor and its effects on the control program are disabled and the laundry in the drum is spun at the maximum set speed.

2. A method according to claim 1, wherein for a drum capacity of 9 kg, the optimum filling amount for wash-and-wear laundry is preset at 3 kg, and at 2 kg for delicates, wool and hand-washables.

3. A method according to claim 2, wherein for a determined weight of loaded laundry up to the optimum filling amount, the spin cycle is run by the control program at a maximum preset speed without taking into account the absorbency.

4. A method according to claim 3, wherein for a determined weight of loaded laundry above the preset weight, the spin cycle is run by the control program with the imbalance sensor activated without taking into account the absorbency.

5. A method according to claim 4, wherein up to the preset weight and for an absorbency greater than 300% of the optimum filled amount, the spin cycle is always run by the control program with the imbalance sensor activated.

6. A method according to claim 5, wherein up to the preset weight and an absorbency below 150% of the optimum filling amount, the spin cycle is run at maximum speed only when the determined weight is below 150% of the optimum filling amount, and for an absorbency between 150% and 300% of the optimum filling amount, the spin cycle is run at the maximum speed only when the determined weight is below a given percentage of the optimum filling amount, whereas the spin cycle is run with an activated imbalance sensor when the weight is greater than the given second weight.

7. A method according to claim 6, wherein the laundry type is manually preset and preferably preselected.

8. A method according to claim 7, wherein the preset weight and absorbency values are stored in a single-chip computer that is fed the determined weight and absorbency.

9. A method according to claim 8, wherein the maximum speed is set at 1,400 rpm for wash-and-wear laundry and at 1,000 rpm for delicates, wool and hand-washables.

* * * * *